US005937973A

United States Patent [19]

Liebetrau

[11] Patent Number: 5,937,973

[45] Date of Patent: Aug. 17, 1999

[54] BRAKE TRIGGERING DEVICE

[75] Inventor: Christoph Liebetrau, Menziken, Switzerland

[73] Assignee: Inventio AG, Hergiswil NW., Switzerland

[21] Appl. No.: 08/964,961

[22] Filed: Nov. 5, 1997

[30] Foreign Application Priority Data

Nov. 11, 1996 [EP] European Pat. Off. ..... 96810763

[51] Int. Cl.[6] ..... B66B 5/04

[52] U.S. Cl. ..... 187/373; 188/82.74

[58] Field of Search ..... 187/373, 376; 188/82.7, 82.74, 82.8, 184, 187

[56] References Cited

U.S. PATENT DOCUMENTS

| | | | |
|---|---|---|---|
| 2,001,361 | 5/1935 | Hymans | 187/376 |
| 5,366,045 | 11/1994 | Liston | 187/376 |

FOREIGN PATENT DOCUMENTS

| | | |
|---|---|---|
| 0 498 597 | 8/1992 | European Pat. Off. . |
| 1 203 933 | 10/1965 | Germany . |
| 1 953 867 | 6/1970 | Germany . |
| 2 258 215 | 2/1993 | United Kingdom . |

*Primary Examiner*—William E. Terrell
*Assistant Examiner*—Gene O Crawford
*Attorney, Agent, or Firm*—MacMillan, Sobanski & Todd, LLC

[57] ABSTRACT

A brake triggering device for an elevator car actuates a pair of brake devices (13) disposed at opposite sides at a car structure (1) from a limiter cable (11) and an entraining lever (10) utilizing a trigger element (2). A small upward movement of the entraining lever (10) releases, by way of a Bowden pull (9) and a trigger mechanism (4), the trigger element (2) which is moved by a spring force to actuate the two brake devices (13) simultaneously. The trigger element (2) is constructed as a torsion spring and has a very short reaction time.

13 Claims, 1 Drawing Sheet

Fig. 1
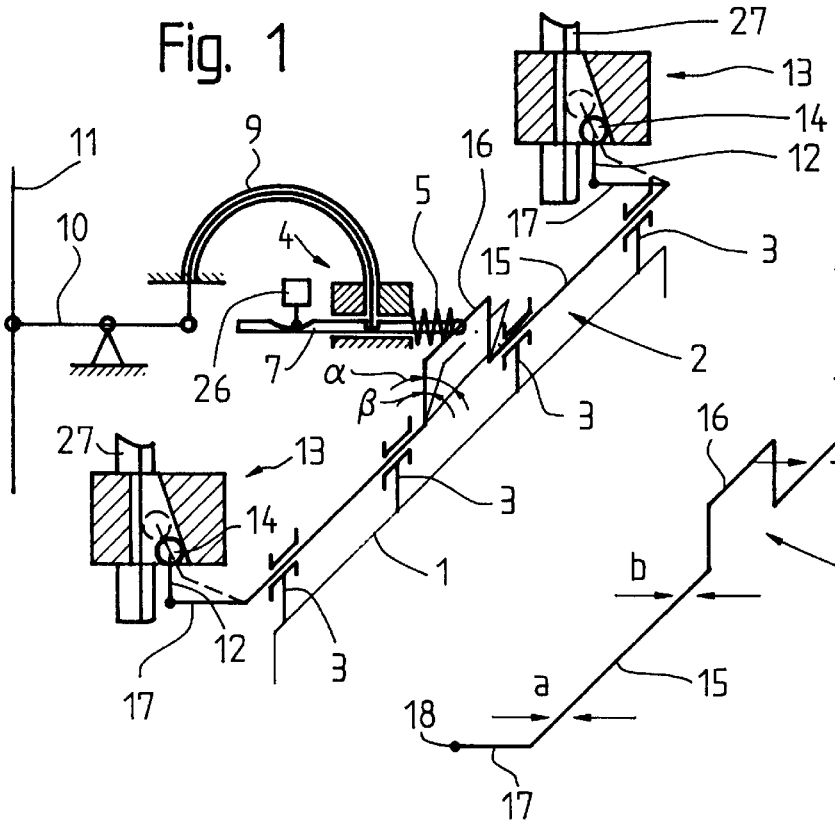
Fig. 2
Fig. 3
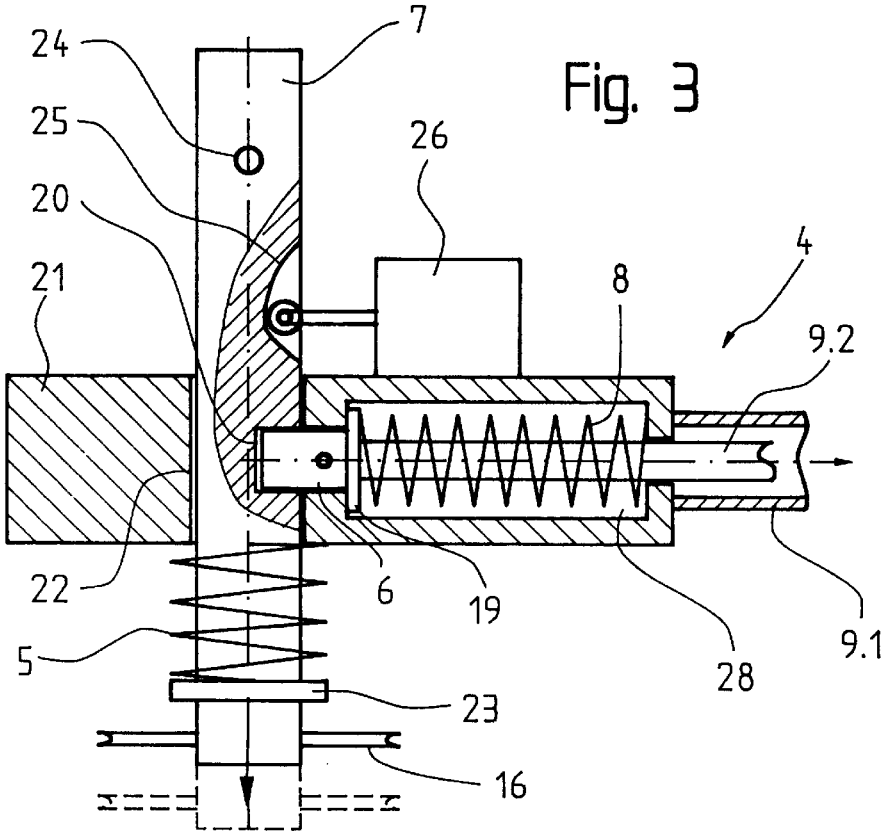

BRAKE TRIGGERING DEVICE

BACKGROUND OF THE INVENTION

The present invention relates to a brake triggering device for an elevator car, by means of which brake devices disposed at both sides of a car structure are actuated by a limiter cable and an entraining lever by way of a transmission element and a trigger element.

It is known that brake devices for elevator cars are actuated by the limiter cable and an entraining lever by way of a linkage. The linkage connects in a known manner and in a crosswise mode the two brake devices disposed laterally of the elevator car.

The European patent specification 0 498 597 discloses a brake device similar to the above-described kind. A limiter cable is connected with the entraining lever at the elevator car, which lever in turn actuates the brake device opposite the entraining lever by way of tensioned connecting cables arranged crosswise and replacing a linkage. Since the brake devices in this known apparatus, as is often usual, are disposed at the underside of the elevator car, they are actuated by the connecting cables by way of upwardly and downwardly arranged parallel rockers similarly connected with the cables.

In the case of the above-mentioned trigger device, the triggering of the brake device takes place by way of several transmission elements, thus indirectly. In addition, the connecting cables must permanently be in a tightly tensioned state, which can lead to high bearing loadings and greater friction losses. Moreover, all transmission elements must transmit the full engaging force for the braking devices. Due to the greater transmission path for the brake device disposed opposite the entraining lever, an absolutely synchronous engaging of the two brake devices is not guaranteed.

In general, with the known solutions a specific delay time between the blocking of the limiter cable by the responding limiter and the effective action of the brake devices results, because the entraining lever must cover a relatively large path for that purpose.

SUMMARY OF THE INVENTION

The present invention concerns a brake triggering device having an improved solution for the proposed purpose and there is thus set the object of creating a brake release device of the kind stated above in which a rapid and synchronous engaging of the brake devices, with greatest functional security, is made possible.

The present invention is distinguished inter alia in that the entraining lever triggers, by means of a trigger mechanism, a trigger element which is biased by spring force and which actuates both brake devices simultaneously with great accuracy with respect to time.

The trigger element connecting and actuating the two brake devices is constructed as a torsion spring.

The part of the trigger element serving as a torsion spring is arranged between two bearing positions connected with the car structure.

The trigger element in the position of readiness exhibits a bias by a determined rotational angle.

A lever part, which serves for the biasing and triggering, at the trigger element is assisted in the triggering direction by a compression spring.

The trigger mechanism comprises a locking pin held in the position of readiness by means of a compression spring, wherein the locking pin engages in a locking notch of the actuating shaft and this keeps the trigger element in the biased setting.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a schematic view of a brake triggering device in accordance with the present invention;

FIG. 2 is a schematic view of the trigger element shown in the FIG. 1; and FIG. 3 is an elevation view in partial section of the trigger mechanism shown in the FIG. 1.

DESCRIPTION OF THE PREFERRED EMBODIMENT

A schematic representation of an elevator car structure is denoted by 1 in the FIG. 1. Bearing positions 3, in which a trigger element 2 is rotatably mounted, are arranged in connection with the car structure 1. The bearing positions 3 are respectively arranged against the ends of torsion parts 15, which extend parallel to the car structure 1, of the trigger element 2. The trigger element 2 has in a middle portion an inverted generally U-shaped and vertically upwardly directed lever part 16. The outer ends of the torsion parts 15 are formed as actuating legs 17 and extend approximately at right angles to the longitudinal axis of the torsion parts as well as approximately in a horizontal plane. The ends of the actuating legs 17 each have a respective joint 18, by means of which a respective pushrod 12 is pivotably connected with a blocking roller 14. The blocking rollers 14 are components of a pair of brake devices 13, which engage around guide rails 27 extending generally vertically along opposite sides of the elevator car structure 1 in an elevator shaft (not shown). By means of a trigger mechanism 4, the lever part 16 of the trigger element 2 is held by an actuating shaft 7 in the illustrated setting, biased by an angle alpha ($\alpha$) to a first position of readiness. A signal switch 26 signals the readiness and trigger position of the trigger mechanism 4. The broken line outline of the lever part 16 shows the relieved setting thereof at an angle beta ($\beta$) when the brake devices 13 are not actuated. The triggering of an actuating lever or shaft 7 is effected by way of a Bowden pull 9, which is operatively connected with an entraining lever 10, and the entraining lever 10 in turn with a limiter cable 11. In the illustrated position, the trigger mechanism 4 is disposed, as already explained, in the position of readiness. In the case of a triggering, apart from the biasing force (angle $\alpha$), the biasing force of a compression spring 5 inserted between the trigger mechanism 4 and the lever part 16 is additionally used as an assisting acceleration force. The outlines, shown dashed, of the lever part 16, the actuating legs 17 and the pushrods 12 with the blocking rollers 14 show the setting of the brake triggering device in the actuated state upon clockwise rotational movement through the angle alpha ($\alpha$).

The trigger element 2 is illustrated by itself in the FIG. 2. The trigger element 2 is preferably homogeneously produced from a single material, which has resilient properties. The torsion parts 15 are thereby formed in that provided at both sides of the inverted U-shaped lever part 16 are straight part members, which extend relative to one another on the same axis and function as the actual torsion parts 15. This torsion function is thereby made possible in that these straight part members are rotatably mounted at their respective ends at spaced apart points "a" and "b". The longest possible torsion path is thus present in each case. Apart from the torsion springing in the torsion parts 15, a slight bending springiness, which does not, however, substantially increase the bias angle alpha (α), additionally takes place in the actuating legs 17 and in the vertical portions of the lever part 16.

The details of the trigger mechanism 4 are illustrated in the FIG. 3. A trigger block 21 fastened to the car structure 1 is provided as a carrier of the trigger mechanism 4. The actuating shaft 7 is mounted in a shaft guide 22 retained in the trigger block 21 to be displaceable in its longitudinal direction. The actuating shaft 7 has an approximately rectangular locking notch 20, which is visible in the partial section and in which a locking pin 6 engages and holds the actuating shaft 7 in the illustrated position of readiness. The locking pin 6 has at the rearward end an abutment shoulder 19 which at the left side bears against the left hand end of a spring chamber 28 and at the right side serves as an abutment for a compression spring 8. The compression spring 8 holds the locking pin 6 in the detented setting and is supported at the right side at the right hand inner wall of the spring chamber 28. A pull wire 9.1 of the Bowden pull 9 is fixedly connected with the locking pin 6 and slides in a Bowden cable casing 9.2, the left end of which bears against the outer side of the spring chamber 28 or of the trigger block 21. Above the trigger block 21, the trigger shaft 7 has a half-round switching notch 25, formed therein into which a contact feeler of the signal switch 26 projects. In the case of a trigger movement of the trigger shaft 7, the contact feeler of the signal switch 26 is pushed in and actuates the contact element in the signal switch. The contact of the contact element in the signal switch 26 is connected as a series contact in the safety circuit of the elevator control (not shown). The movement travel of the trigger shaft 7 is limited by an abutment pin 24, wherein this abutment pin 24 has a significance only in the mounting process and never comes into abutment during the elevator operation or in the case of a trigger operation.

Before putting the brake trigger equipment into action, the brake devices 13 are, in the illustrated setting shown in the FIG. 1, and the trigger element 2 or the lever part 16 thereof is still disposed in the relieved setting shown by a broken line outline at a second angle beta (β). Then the lever part 16 and the trigger shaft 7 are pressed to the left against the torsion force of the trigger part 2 and against the force of the compression spring 5 until the locking pin 6 detents in the locking notch 20 of the actuating shaft 7. The compression spring 5 acts between the trigger block 21 and an abutment shoulder 23 formed on the trigger shaft 7. After this operation, the brake trigger device is disposed in the position of readiness. The position of readiness is also electrically signaled by way of the now retracted signal switch 26 to the safety circuit and closed at this position of the safety circuit. If the limiter in the motor room is, as a consequence of excess speed, now triggered or blocked, the limiter cable 11 draws the left-hand leg of the entraining lever 10 upwardly, the right-hand leg of which moves downwardly and draws the Bowden pull wire 9.2 downwardly, wherein the other end thereof draws the locking pin 6 out of the locking notch 20 against the force of the compression spring 8 and releases the trigger shaft 7. The trigger shaft 7 moves, by the acceleration force of the biased lever part 16 and the biased compression spring 5, in the arrow direction (FIG. 3), wherein the trigger element 2, which is operatively connected with the trigger shaft 7, is sharply rotated to jump the blocking rollers 14 of the brake devices 13 upwardly into the brake settings by way of the pushrods 12 and holds the blocking rollers 14 in the braking setting by means of the only partially relieved compression spring 5.

The relatively large stored biasing and pressure forces of the trigger element 2 and the compression spring 5 cause a high acceleration of the relatively small mass of the trigger element 2 during the triggering. That expresses itself in a very short reaction time between limiter blocking and brake action, as well as in an optimally synchronous actuation of the two brake devices. A further factor contributing to the short reaction time is the circumstance that the entraining lever 10, by comparison with known solutions, only has to cover a fraction of the travel for triggering, because the triggering travel of the locking pin 6 is substantially shorter than the entire engagement travel of a brake device 13.

The form of the trigger element 2 is not restricted to the shown form. According to the respective kind of car structure 1 and place of arrangement, parts of the trigger element 2 as well as the geometry thereof can depart generally from the illustrated form to a greater or lesser extent. The placement thereof can be provided not only above an elevator car, but also below the same. It is essential only that the trigger element 2 consists of spring-elastic material and has part members, which are as straight as possible, suitable for a torsion springing.

For the purpose of reducing the trigger force at the locking pin 6, this can have a partly recessed roller or ball, which is not illustrated, at the point of contact with the abutment wall of the locking notch 20.

Instead of the trigger shaft 7 with the locking notch 20 and the locking pin 6, a pawl lever, which is not illustrated, can also come into use, the pawl or hook of which engages behind the lever part 16 and which is drawn away from the lever part 16, which is engaged behind, by way of the Bowden pull 9 analogously to the drawing back of the locking pin 6, and frees this. The compression spring 5 is then likewise used again and restrained between the lever part 16 and a part of the car structure.

In summary, the brake triggering device for an elevator car having the brake devices 13 disposed on opposite sides of the car structure 1, the brake devices being actuated by the limiter cable 11 attached to the entraining lever 10, includes: the trigger element 2 connected to the pair of brake devices on the elevator car structure and including the spring means 15, the trigger element being biased to the first position of readiness against the spring force applied by the spring means; and the trigger mechanism 4 connected between the trigger element and the entraining lever attached to the limiter cable for the car structure, the trigger mechanism maintaining the biased trigger element in the first position of readiness, whereby when the limiter cable moves the entraining lever in response to an excess speed condition of the car structure, the trigger mechanism releases the trigger element which is accelerated by the spring force applied by the spring means from the first position of readiness to the second position of brake setting to actuate the brake devices with a relatively short reaction time.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A brake triggering device for an elevator car having brake devices disposed on opposite sides of a car structure, the brake devices being actuated by a limiter cable attached to an entraining lever, comprising:

a trigger element connected to a pair of brake devices on an elevator car structure and including a spring means, said trigger element being biased to a first position of readiness against a spring force applied by said spring means, said trigger element being formed as a torsion spring having said spring means formed as at least one torsion part to apply said spring force; and a trigger mechanism connected between said trigger element and an entraining lever attached to a limiter cable for the car structure, said trigger mechanism maintaining said biased trigger element in the first position of readiness, whereby when the limiter cable moves the entraining lever in response to an excess speed condition of the car structure, said trigger mechanism releases said trigger element which is accelerated by said spring force applied by said spring means from said first position of readiness to a second position of brake setting to actuate the brake devices with a relatively short reaction time.

2. The brake triggering device according to claim 1 wherein said trigger element actuates both of the braking devices simultaneously in said second position of brake setting.

3. The brake triggering device according to claim 1 wherein said trigger element has said spring means formed as a torsion part acting as a torsion spring and supported at opposite ends thereof in bearing positions connected with the car structure enabling a rotational movement of the trigger element relative to the car structure.

4. The brake triggering device according to claim 1 including a compression spring connected between said trigger element and said trigger mechanism for assisting movement of said trigger element from the first position of readiness to the second position of brake setting.

5. The brake triggering device according to claim 1 wherein said trigger mechanism includes a locking pin held in engagement with said trigger element by a compression spring, said locking pin being operatively connected with the limiter cable by way of a Bowden pull and the entraining lever.

6. The brake triggering device according to claim 1 wherein said trigger mechanism includes a trigger shaft which is operatively connected between the entraining lever and a lever part of said trigger element, said trigger shaft having a locking notch formed therein and a locking pin engaging in said locking notch in said first position of readiness to prevent movement of said trigger shaft.

7. The brake triggering device according to claim 6 wherein said locking pin is held in engagement with said locking notch by a compression spring and is operatively connected with the limiter cable by a Bowden pull and the entraining lever.

8. The brake triggering device according to claim 1 wherein said trigger element is biased at an angle alpha ($\alpha$) in the first position of readiness relative to the second position of brake setting.

9. The brake triggering device according to claim 8 wherein said trigger element has a lever part formed therein that is biased at the angle alpha ($\alpha$) in the first position of readiness.

10. The brake triggering device according to claim 1 wherein said trigger mechanism includes a trigger shaft connected between the entraining lever and said trigger element, said trigger shaft having a switching notch formed therein for actuating a signal switch.

11. The brake triggering device according to claim 10 wherein said locking notch has a half-round shape.

12. A brake triggering device for an elevator car having brake devices disposed on opposite sides of a car structure, the brake devices being actuated by a limiter cable attached to an entraining lever, comprising:

a trigger element connected to a pair of brake devices on an elevator car structure, said trigger element being formed as a torsion spring having at least one torsion part and being biased to a first position of readiness against a first spring force applied by said torsion part; and a trigger mechanism connected between said trigger element and an entraining lever attached to a limiter cable for the car structure, said trigger mechanism maintaining said biased trigger element in the first position of readiness, whereby when the limiter cable moves the entraining lever in response to an excess speed condition of the car structure, said trigger mechanism releases said trigger element which is accelerated by said first spring force applied by said torsion part from said first position of readiness to a second position of brake setting to actuate the brake devices with a relatively short reaction time.

13. A brake triggering device for an elevator car having brake devices disposed on opposite sides of a car structure, the brake devices being actuated by a limiter cable attached to an entraining lever, comprising:

a trigger element including a torsion spring having a pair of torsion parts each connected to one of a pair of brake devices on an elevator car structure, said trigger element being biased to a first position of readiness against a spring force applied by said torsion parts; and a trigger mechanism connected between said trigger element and an entraining lever attached to a limiter cable for the car structure, said trigger mechanism maintaining said biased trigger element in the first position of readiness, whereby when the limiter cable moves the entraining lever in response to an excess speed condition of the car structure, said trigger mechanism releases said trigger element which is accelerated by said spring force applied by said torsion parts from said first position of readiness to a second position of brake setting to actuate the brake devices with a relatively short reaction time.

* * * * *